US008860620B2

(12) United States Patent
Kitano

(10) Patent No.: US 8,860,620 B2
(45) Date of Patent: Oct. 14, 2014

(54) ELECTROMAGNETIC WAVE RADIATION COAXIAL CABLE AND COMMUNICATION SYSTEM USING THE SAME

(75) Inventor: Nobuaki Kitano, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 191 days.

(21) Appl. No.: 13/431,867

(22) Filed: Mar. 27, 2012

(65) Prior Publication Data

US 2012/0268336 A1 Oct. 25, 2012

(30) Foreign Application Priority Data

Apr. 25, 2011 (JP) ..... 2011-097309

(51) Int. Cl.
*H01Q 11/08* (2006.01)
*H01B 13/00* (2006.01)
*H01B 11/18* (2006.01)

(52) U.S. Cl.
CPC ..... *H01Q 11/08* (2013.01)
USPC ..... 343/791; 343/790; 343/792

(58) Field of Classification Search
CPC ..... H01B 11/18; H01B 13/00
USPC ..... 343/790, 791, 792
See application file for complete search history.

(56) References Cited

U.S. PATENT DOCUMENTS 5,936,203 A * 8/1999 Ryman ..... 174/109

FOREIGN PATENT DOCUMENTS

JP 09-198941 A 7/1997
JP 2010-103685 A 5/2010

OTHER PUBLICATIONS

Li et al. "Polarization Property of Leaky Coaxial Cable With Overlapped Triangle Slots" Antennas and Wireless Propagation Letters, IEEE (vol. 9); pp. 1049-1052. Nov. 2010.*

* cited by examiner

*Primary Examiner* — Dameon E Levi
*Assistant Examiner* — Ricardo Magallanes
(74) *Attorney, Agent, or Firm* — McGinn IP Law Group, PLLC

(57) ABSTRACT

An electromagnetic wave radiation coaxial cable and a communication system using the same. The electromagnetic wave radiation coaxial cable includes an inner conductor which is formed of a conductor and extends along a cable axis, an insulator covering the inner conductor, and an outer conductor spirally wound around the insulator in a single winding at a predetermined pitch to provide a gap from which a part of the insulator is exposed. Following formula is established:

$$\sqrt{\varepsilon_r} - 1 < \frac{\lambda}{P} < \sqrt{\varepsilon_r} + 1$$

when λ is a wavelength of a radio frequency signal to be transmitted or received, $\in_r$ is a relative dielectric constant of the insulator at the wavelength λ, and P is a winding pitch of the outer conductor along the direction of the cable axis.

18 Claims, 9 Drawing Sheets

5D

ELECTROMAGNETIC WAVE RADIATION COAXIAL CABLE AND COMMUNICATION SYSTEM USING THE SAME

The present application is based on Japanese patent application No. 2011-097309 filed on Apr. 25, 2011, the entire contents of which are incorporated herein by reference.

BACKGROUND OF THE INVENTION

1. Field of the Invention

The present invention relates to an electromagnetic wave radiation coaxial cable and a communication system using the same.

2. Description of the Related Art

Conventionally, opened coaxial cables and leaky coaxial cables have been proposed as a transmitting antenna for mobile communication. For example, Japanese Patent Laid-Open No. 9-198941 (JP-A 9-198941) and Japanese Patent Laid-Open No. 2010-103685 (JP-A 2010-103685) disclose the conventional opened coaxial cable and the conventional leaky coaxial cable, respectively.

Each of opened coaxial cables as described in FIGS. 10A and 10B of JP-A 9-198941 has a helical (spiral) opened groove. When a high frequency signal (i.e. radio frequency signal) is supplied to the opened coaxial cable, the electromagnetic field is leaked out through the opened groove. A receiving antenna provided outside detects the leaked electromagnetic field by inductive coupling.

On the other hand, a leaky coaxial cable as described in FIG. 7 of JP-A 9-198941 and FIG. 1 of JP-A 2010-103685 has a slot. When a radio frequency signal is supplied to the leaky coaxial cable, the electromagnetic field is radiated through the slot. A receiving antenna provided outside detects the radiated electromagnetic wave.

SUMMARY OF THE INVENTION

The helical (spiral)-type opened coaxial cables described in FIGS. 10A and 10B of JP-A 9-198941 are inductive coupling type antennas. If the opened coaxial cable shown in JP-A 9-198941 is used as a transmitting antenna, antenna characteristics such as transmission loss, coupling loss may be varied remarkably depending on the distance from the transmitting antenna to a receiving antenna, the dirt on the surface or the like of the opened coaxial cable per se, or the like.

On the other hand, the slot-type leaky coaxial cables as described in FIG. 7 of JP-A 9-198941 and FIG. 1 of JP-A 2010-103685 can radiate only linear polarized electromagnetic wave. Therefore, when using this leaky coaxial cable as the transmitting antenna, the coupling loss will be deteriorated unless the receiving antenna is positioned along an amplitude direction of the linear polarized wave.

The present invention is provided for solving the above circumstances. An object of the present invention is to provide an electromagnetic wave radiation coaxial cable, which is capable of radiating a circular polarized wave when the radio frequency signal is input, and a communication system using the same.

According to a first feature of the invention, an electromagnetic wave radiation coaxial cable comprises:

an inner conductor comprising a conductor and extending along a cable axis;

an insulator covering the inner conductor; and an outer conductor spirally wound around the insulator in a single winding at a predetermined pitch to form a gap from which a part of the insulator is exposed, wherein a formula is established as:

$$\sqrt{\varepsilon_r} - 1 < \frac{\lambda}{P} < \sqrt{\varepsilon_r} + 1$$

wherein λ is a wavelength of a radio frequency signal to be transmitted or received, $\in_r$ is a relative dielectric constant of the insulator at the wavelength λ, and P is a winding pitch of the outer conductor along the direction of the cable axis.

An occupation ratio of the outer conductor at a surface of the insulator is preferably 50% or more.

A width of the gap in a direction perpendicular to side edges of the outer conductor when the gap is projected on a plane including the cable axis is preferably 0.5 mm or more.

The outer conductor may comprise a metal foil or a plurality of conductor wires.

The electromagnetic wave radiation coaxial cable may radiate a circular polarized electromagnetic wave when the radio frequency signal is applied to the inner conductor.

A frequency of the radio frequency signal is preferably within a range from 800 MHz to 2400 MHz.

According to a second feature of the invention, a communication system comprises:

an electromagnetic wave radiation coaxial cable as an antenna, the electromagnetic wave radiation coaxial cable comprising an inner conductor comprising a conductor and extending along a cable axis, an insulator covering the inner conductor, and an outer conductor spirally wound around the insulator in a single winding at a predetermined pitch to form a gap from which a part of the insulator is exposed, wherein a formula is established as:

$$\sqrt{\varepsilon_r} - 1 < \frac{\lambda}{P} < \sqrt{\varepsilon_r} + 1$$

wherein λ is a wavelength of a radio frequency signal to be transmitted or received, $\in_r$ is a relative dielectric constant of the insulator at the wavelength λ, and P is a winding pitch of the outer conductor along the direction of the cable axis.

An occupation ratio of the outer conductor at a surface of the insulator is preferably 50% or more.

A width of the gap in a direction perpendicular to side edges of the outer conductor when the gap is projected on a plane including the cable axis is preferably 0.5 mm or more.

The outer conductor may comprise a metal foil or a plurality of conductor wires.

The electromagnetic wave radiation coaxial cable may radiate a circular polarized electromagnetic wave when the radio frequency signal is applied to the inner conductor.

A frequency of the radio frequency signal is preferably within a range from 800 MHz to 2400 MHz.

Effects of the Invention

According to the present invention, it is possible to provide an electromagnetic wave radiation coaxial cable, which is capable of radiating a circular polarized wave when the radio frequency signal is input, and a communication system using the same.

BRIEF DESCRIPTION OF THE DRAWINGS

The embodiments according to the invention will be explained below referring to the drawings, wherein.

DETAILED DESCRIPTION OF THE PREFERRED EMBODIMENTS

Next, embodiments according to the present invention will be explained in more detail in conjunction with the appended drawings.

First Embodiment

Figure 1:
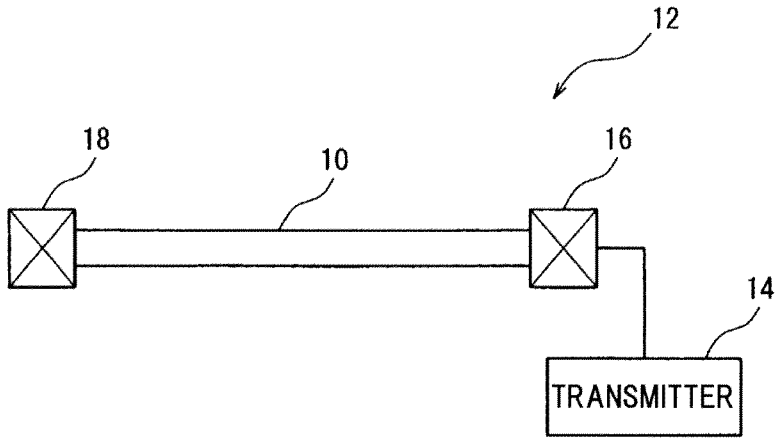
FIG. 1 is a schematic diagram of a transmission system using an electromagnetic wave radiation coaxial cable in a first embodiment according to the invention.

FIG. 1 is a schematic diagram of a transmission system 12 using an electromagnetic wave radiation coaxial cable 10 in the first embodiment according to the invention.

The transmission system 12 includes a transmitter 14 which generates and outputs a radio frequency signal. The transmitter 14 is connected to a node (feeding point) 16 via a feeding line, and the node 16 is connected to one end of the electromagnetic wave radiation coaxial cable 10. Further, the transmission system 12 includes a terminator (dummy resistor) 18, which is connected to the other end of the electromagnetic wave radiation coaxial cable 10.

Figure 2:
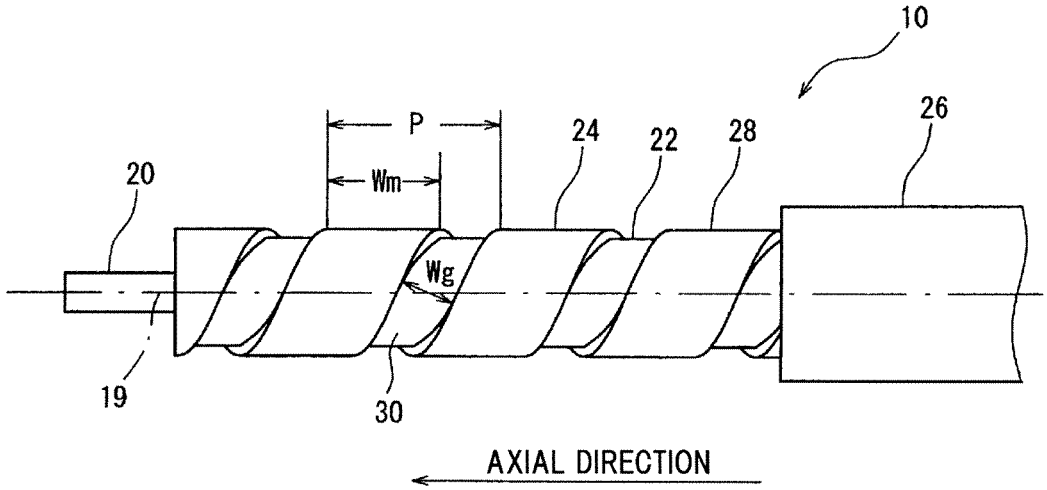
FIG. 2 is a schematic diagram showing a side view of the electromagnetic wave radiation coaxial cable in FIG. 1.
Figure 3:
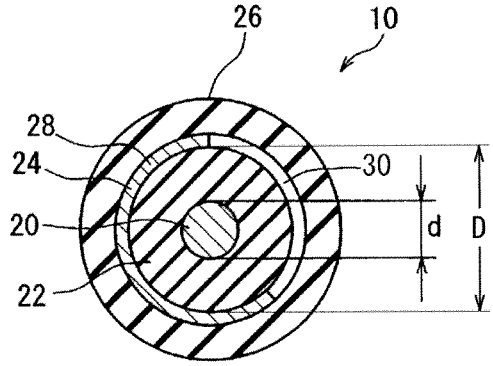
FIG. 3 is a schematic diagram showing a transverse cross sectional view of the electromagnetic wave radiation coaxial cable in FIG. 1.

FIG. 2 is a schematic diagram showing a side view of the electromagnetic wave radiation coaxial cable 10 in FIG. 1. FIG. 3 is a schematic diagram showing a transverse cross sectional view of the electromagnetic wave radiation coaxial cable 10 in FIG. 1.

Referring to FIGS. 2 and 3, the electromagnetic wave radiation coaxial cable 10 includes a linear inner conductor 20 made of a conductor such as copper, which extends along a cable axis 19. An outer periphery surface of the inner conductor 20 is covered with a cylindrical insulator 22 provided concentrically with the linear inner conductor 20.

As the material of the insulator 22, e.g. polyethylene, polytetrafluoroethylene, polyvinyl chloride, or a foamed material thereof may be used. A relative dielectric constant (relative permittivity) $\in_r$ of the insulator 22 is e.g. from 1.0 to 3.0 (1.0 or more and 3.0 or less).

The outer periphery surface of the insulator 22 is provided with an outer conductor 24. An inner diameter D of the outer conductor 24 is e.g. from 3 mm to 50 mm (i.e. 3 mm or more and 50 mm or less). For example, an outer diameter d of the inner conductor 20 may be appropriately adjusted with considering the relative dielectric constant $\in_r$ of the insulator 22 such that characteristic impedance of the electromagnetic wave radiation coaxial cable 10 is 50Ω or 75Ω.

An outer periphery surface of the outer conductor 24 is covered with an electrically insulating sheath 26. As the material of the sheath 26, e.g. polyethylene, polyvinyl chloride, or a non-halogen flame retardant material may be used.

In the first embodiment, a single band-shape metal foil 28 is spirally wound as the outer conductor 24 in a single winding (i.e. in single-helix) around the insulator 22. As the material of the metal foil 28, e.g. copper, aluminum, or silver may be used. For example, the metal foil 28 may have a thickness from 50 μm to 300 nm (i.e. 50 μm or more and 300 μm or less). The width of the outer conductor 24 (outer conductor width) Wm is a length of the metal foil 28 in a direction along the cable axis 19 of the inner conductor 20 (axial direction).

The metal foil 28 is spirally wound in a single winding at a predetermined pitch P. The pitch P is a winding period of the metal foil 28 in the axial direction of the electromagnetic wave radiation coaxial cable 10, namely, a length of the advance of the metal foil 28 in the axial direction of the inner conductor 22 when the metal foil 28 is wound around the insulator 22 in one revolution.

The pitch P is greater than the outer conductor width Wm. Thus, the metal foil 28 is wound around the outer periphery surface of the insulator 22 while forming a single spiral groove (gap) 30, from which a part of the insulator 22 is exposed. The width of the gap 30 (gap width) Wg is e.g. from 0.9 mm to 6 mm (0.9 mm or more and 6 mm or less). In addition, the gap width Wg is an interval between adjacent windings (turns) in a direction perpendicular to the side edges of the metal foil 28 when the gap 30 is projected on a plane including the cable axis 19.

In the electromagnetic wave radiation coaxial cable 10 of the first embodiment, the relationship represented by the following Formula (1) is established. In the Formula (1), λ is a wavelength of the radio frequency signal to be transmitted or received (design wavelength), $\in_r$ is a relative dielectric constant of the insulator 22 at the wavelength λ, and P is a winding pitch of the metal foil 28 along the direction of the cable axis 19. In addition, the relative dielectric constant $\in_r$ of the insulator 22 has a frequency dependency, and is naturally the value at a frequency of the radio frequency signal to be applied. The radio frequency signal means a signal at a frequency band used for mobile communication such as mobile phone, television broadcast, wireless LAN, etc. For example, the radio frequency signal is the signal at frequency of several hundreds MHz to several GHz.

(Formula 1)

$$\sqrt{\varepsilon_r} - 1 < \frac{\lambda}{P} < \sqrt{\varepsilon_r} + 1 \quad (1)$$

In the electromagnetic wave radiation coaxial cable 10 of the first embodiment, an occupation ratio (metal-cover ratio) of the metal foil 28 at the outer periphery surface of the insulator 22 is preferably set to be 50% or more. In other words, the value Wm/P which is obtained by dividing the outer conductor width Wm by the pitch P is preferably set to be 0.5 or more.

Further, in the electromagnetic wave radiation coaxial cable 10 of the first embodiment, the gap width Wg is preferably set to be 0.5 mm or more.

(Method for Manufacturing the Electromagnetic Wave Radiation Coaxial Cable 10)

The electromagnetic wave radiation coaxial cable 10 of the first embodiment as described above may be manufactured by e.g. winding the metal foil 28 around the outer periphery surface of the insulator 22 which covers the inner conductor 20, and covering the metal foil 28 with the sheath 26.

According to the electromagnetic wave radiation coaxial cable 10 in the first embodiment described above, if the condition expressed in Formula (1) is satisfied, when a radio frequency signal is input to the inner conductor 20, a circular polarized electromagnetic wave corresponding to a spiral winding direction of the outer conductor 24 is stably radiated.

Therefore, the receiving system which communicates with the transmission system 12 is capable of receiving the radio frequency signal stably, regardless of the orientation of the receiving antenna with respect to the electromagnetic wave radiation coaxial cable 10.

For this reason, the electromagnetic wave radiation coaxial cable 10 is suitable for polarization diversity radiation cable, GPS transmission and reception radiation cable, a radiation cable used for communication with mobile devices.

Further, the electromagnetic wave radiation coaxial cable 10 may be also applied to the receiving system, since the electromagnetic wave radiation coaxial cable 10 has good reception sensitivity regardless of the orientation as a receiving antenna. In other words, the electromagnetic wave radiation coaxial cable 10 is applicable to both of the transmitter and the receiver of the communication system.

According to the electromagnetic wave radiation coaxial cable 10 in the first embodiment, unlike the conventional opened coaxial cables, the electromagnetic wave is radiated. Accordingly, the electromagnetic field characteristics such as transmission loss and coupling loss are stable (i.e. the variation thereof are small).

Further, the electromagnetic wave radiation coaxial cable 10 of the first embodiment is less affected by the dirt on the surface or the like of the sheath 26.

Still further, the electromagnetic wave radiation coaxial cable 10 in the first embodiment can be easily manufactured, as compared to the conventional slot type leaky coaxial cables.

EXAMPLES

Figure 4:
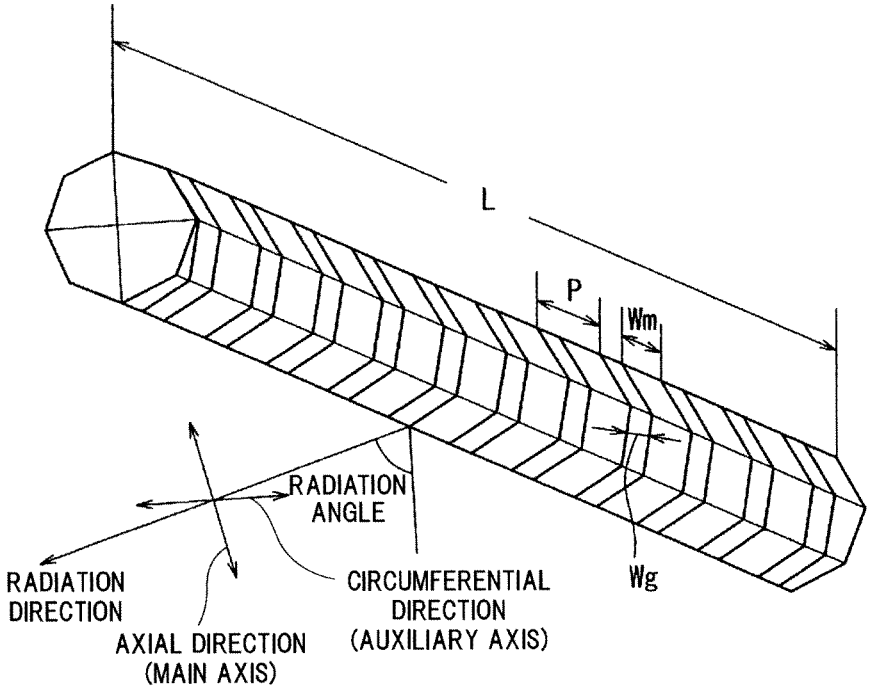
FIG. 4 is a schematic diagram showing a model of the electromagnetic wave radiation coaxial cable used for simulation.

Next, simulation results of the electromagnetic wave radiation coaxial cable 10 in Examples of the first embodiment are shown below. As a simulator, an electromagnetic field simulator WIPL-D (manufactured by WIPL-D, Inc.) was used. FIG. 4 is a schematic diagram showing a model of the electromagnetic wave radiation coaxial cable used for simulation.

1. Examples 1 to 3

(1-1. Parameters)

Inner diameter D of the outer conductor: 5 mm
Outer diameter d of the inner conductor: 2 mm
Pitch P: 200 mm
Outer conductor width Wm: 137.5 mm
Metal-cover ratio: 69%
Gap width Wg: 4.9 mm
Relative dielectric constant $\in_r$ of the insulator: 1.277
Cable length L: 2 m
Radio frequency: 800 MHz (Example 1)
1800 MHz (Example 2)
2400 MHz (Example 3)

(1-2. Evaluation Results of Directivities)

Figure 5:
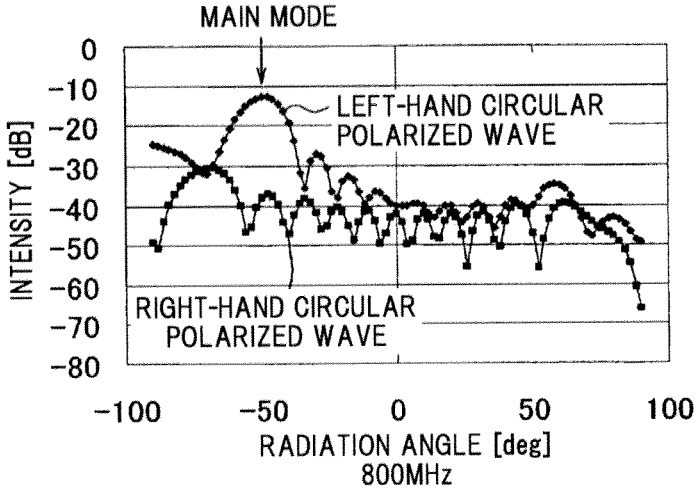
FIG. 5 is a graph showing a radiation angle dependency of intensities of left-hand circular polarized wave and right-hand circular polarized wave in Example 1 (800 MHz)
Figure 6:
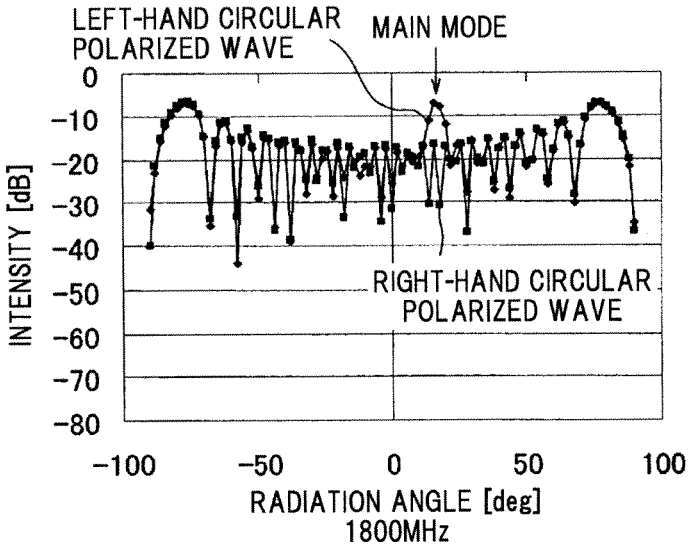
FIG. 6 is a graph showing a radiation angle dependency of intensities of left-hand circular polarized wave and right-hand circular polarized wave in Example 2 (1800 MHz)
Figure 7:
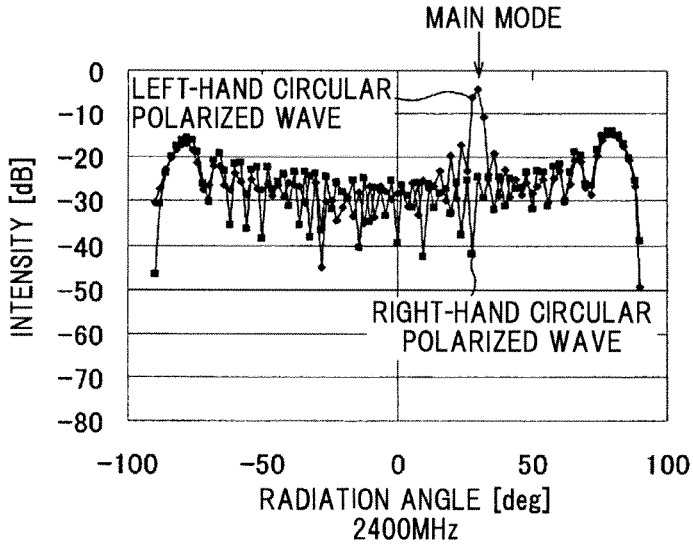
FIG. 7 is a graph showing a radiation angle dependency of intensities of left-hand circular polarized wave and right-hand circular polarized wave in Example 3 (2400 MHz)

(1) Radiation Angle Dependency of Intensities of a Left-Hand Circular Polarized Wave and a Right-Hand Circular Polarized Wave for Each Frequency FIGS. 5 to 7 show the radiation angle dependency of the intensities of the left-hand circular polarized wave and the right-hand circular polarized wave in Examples 1 to 3, respectively. The radiation angle is set to be 0° with respect to the direction perpendicular to the axial direction.

Referring to FIGS. 5 to 7, the radiation of the left-hand circular polarized wave at the radiation angle shown as a main mode was observed for all of 800 MHz, 1800 MHz and 2400 MHz. It can be clearly understood from the above results that the electromagnetic wave can be radiated toward a specific orientation from the electromagnetic wave radiation coaxial cables 10 in Examples 1 to 3.

Herein, the electromagnetic wave radiated from the electromagnetic wave radiation coaxial cable was the left-hand circular polarized wave, since the metal foil 28 was wound in a clockwise winding direction along the axial direction as shown in FIG. 2. If the metal foil 28 is wound in a counter-clockwise winding direction along the axial direction in the model used for simulation, the right-hand circular polarized wave will be radiated.

Figure 8:
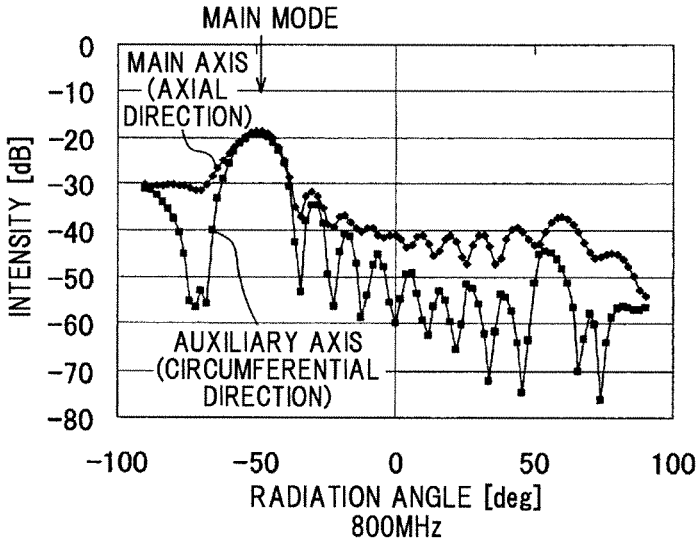
FIG. 8 is a graph showing a radiation angle dependency of intensities in a main axis and an auxiliary axis in Example 1 (800 MHz)
Figure 9:
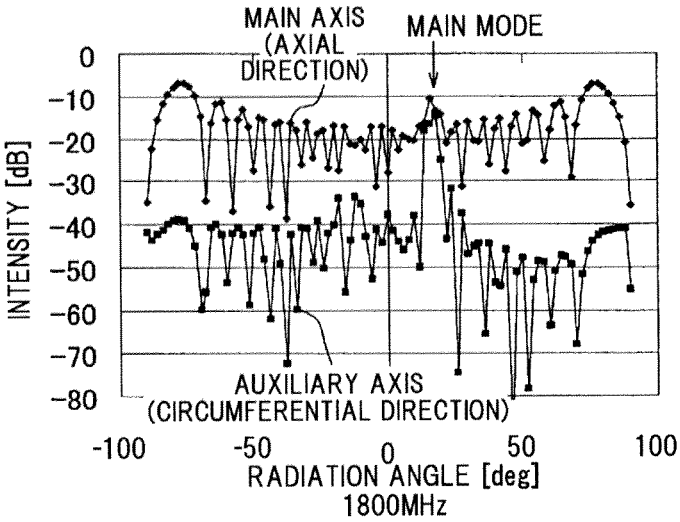
FIG. 9 is a graph showing a radiation angle dependency of intensities in a main axis and an auxiliary axis in Example 2 (1800 MHz)
Figure 10:
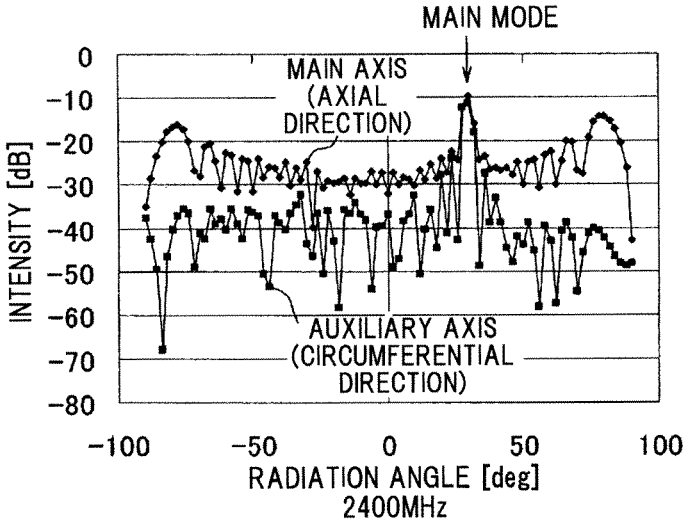
FIG. 10 is a graph showing a radiation angle dependency of intensities in a main axis and an auxiliary axis in Example 3 (2400 MHz)

(2) Radiation Angle Dependency of Intensities in a Main Axis and an Auxiliary Axis for Each Frequency FIGS. 8 to 10 show the radiation angle dependency of the intensities of the main axis (primary axis) and the auxiliary axis (secondary axis) in Examples 1 to 3, respectively. Herein, the auxiliary axis substantially coincides with a direction parallel to the circumferential direction of the electromagnetic wave radiation coaxial cable (hereinafter referred to as "circumferential direction"), and the main axis substantially coincides with a direction perpendicular to the radiation direction and the circumferential direction (hereinafter referred to as "axial direction").

Referring to FIGS. 8 to 10, an axial ratio (AR) of electromagnetic wave was 1 dB or less at the radiation angle shown as a main mode was observed for all of 800 MHz, 1800 MHz and 2400 MHz. It can be clearly understood from the above results that in the case of using a dipole antenna for receiving the electromagnetic wave radiated from the electromagnetic wave radiation coaxial cables in Examples 1 to 3, a certain level of intensity can be obtained regardless of the orientation of the dipole antenna.

2. Example 4

(2-1. Parameters)

Inner diameter D of the outer conductor: 5 mm

Outer diameter d of the inner conductor: 2 mm

Pitch P: 200 mm

Outer conductor width Wm: 137.5 mm

Metal-cover ratio: 69%

Gap width Wg: 4.9 mm

Relative dielectric constant $\in_r$ of the insulator: 1.277

Cable length L: 2 m

Radio frequency: 2400 MHz

A distance between a cable and a dipole antenna: 2 m (2-2. Evaluation Results of Positioning Characteristic of a Coupling Loss of an Axial Direction Polarized Wave and a Circumferential Direction Polarized Wave)

Figure 11:
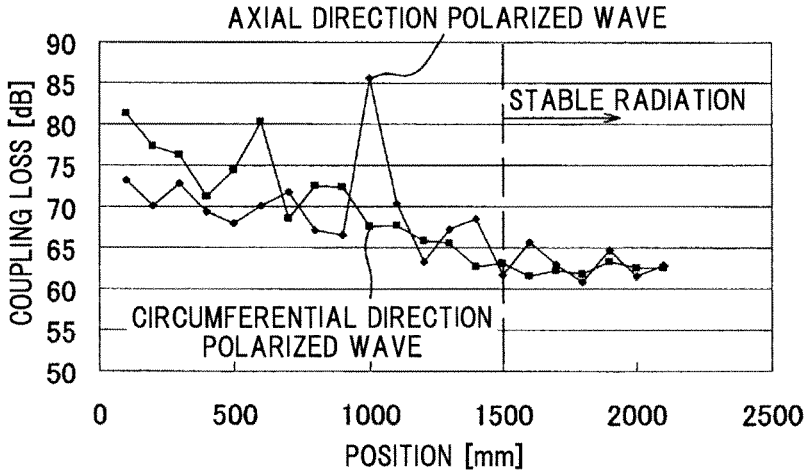
FIG. 11 is a graph showing a positioning characteristic of coupling loss of an axial direction polarized wave and a circumferential direction polarized wave in Example 4 (2400 MHz)

FIG. 11 shows the positioning characteristic (dependency to the position) of the coupling loss of the axial direction polarized wave and the circumferential direction polarized wave in Example 4. A position of 0 mm in a horizontal axis corresponds to the feeding point.

As shown in FIG. 11, both the circumferential direction polarized wave and the axial direction polarized wave were radiated stably within a range of about 1500 mm to 2000 mm. On the other hand, in relation to the directivity, the coupling loss increased at 0 mm side compared with 1500 mm side.

3. Examples 5 to 8 and 9 to 12

Inner diameter D of the outer conductor: 5 mm (Examples 5 to 8)

10 mm (Examples 9 to 12)

Outer diameter d of the inner conductor: 2 mm (Examples 5 to 8)

4 mm (Examples 9 to 12)

Pitch P: 200 mm

Metal-cover ratio: 95% (Examples 5 and 9)

69% (Examples 6 and 10)

50% (Examples 7 and 11)

25% (Examples 8 and 12)

Relative dielectric constant Er of the insulator: 1.277

Cable length L: 2 m

Radio frequency: 800 MHz to 2400 MHz (3-2. Evaluation Results of a Relationship Between a Metal-Cover Ratio and VSWR (Voltage Standing Wave Ratio))

Figure 12:
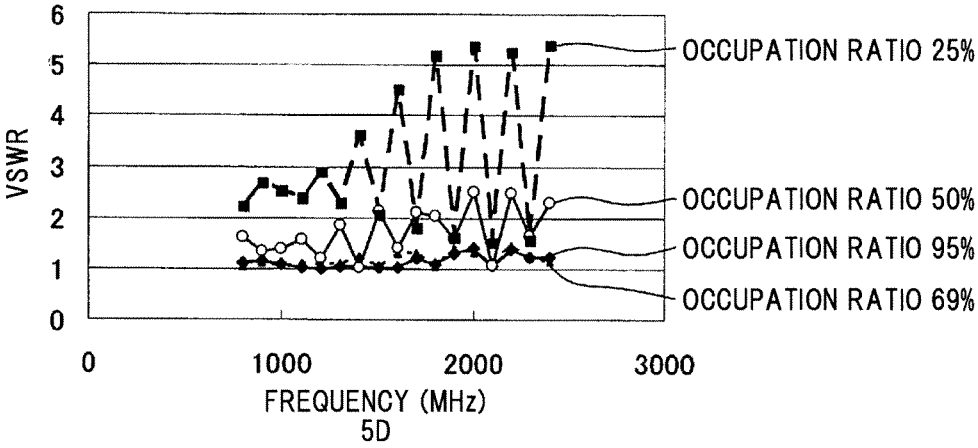
FIG. 12 is a graph showing a relationship between a metal cover ratio (occupation ratio) and VSWR (Voltage Standing Wave Ratio) within a range from 800 MHz to 2400 MHz in Examples 5 to 8 (5D)
Figure 13:
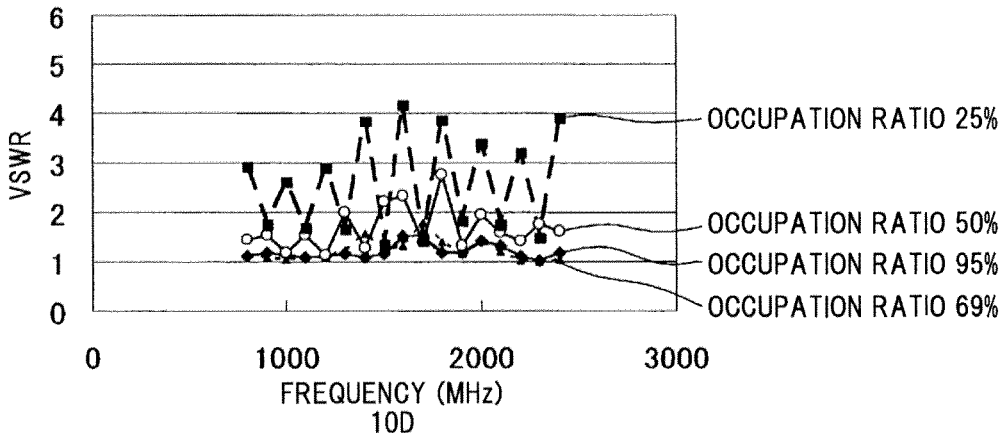
FIG. 13 is a graph showing a relationship between a metal cover ratio (occupation ratio) and VSWR (Voltage Standing Wave Ratio) within a range from 800 MHz to 2400 MHz in Examples 9 to 12 (10D)

FIGS. 12 and 13 show the relationship between the metal cover ratio (occupation ratio) and the VSWR (Voltage Standing Wave Ratio) within a range from 800 MHz to 2400 MHz in Examples 5 to 8 (5D: the inner diameter D of the outer conductor is 5 mm) and Examples 9 to 12 (10D: the inner diameter D of the outer conductor is 10 mm), respectively.

The VSWR is preferably 2 or less. It would be clearly understood from FIGS. 12 *and* 13 that the metal-cover ratio is preferably 50% or more, and more preferably 69% or more, for achieving the desired value of the VSWR.

4. Examples 13 to 16 and 17 to 21

(4-1. Parameters)

Inner diameter D of the outer conductor: 5 mm (Examples 13 to 16)

10 mm (Examples 17 to 21)

Outer diameter d of the inner conductor: 2 mm (Examples 13 to 16)

4 mm (Examples 17 to 21)

Pitch P: 200 mm

Gap width Wg: 0.8 mm, 1.6 mm, 4.9 mm, 7.8 mm (Examples 13 to 16)

0.8 mm, 1.6 mm, 3.9 mm, 9.7 mm, 15.5 mm (Examples 17 to 21)

Relative dielectric constant $\in$r of the insulator: 1.277

Cable length L: 2 m

Radio frequency: 800 MHz to 2400 MHz

A distance between a cable and a dipole antenna: 2 on (4-2. Evaluation Results of Gap Width Dependency of a Coupling Loss of a Circumferential Direction Polarized Wave)

Figure 14:
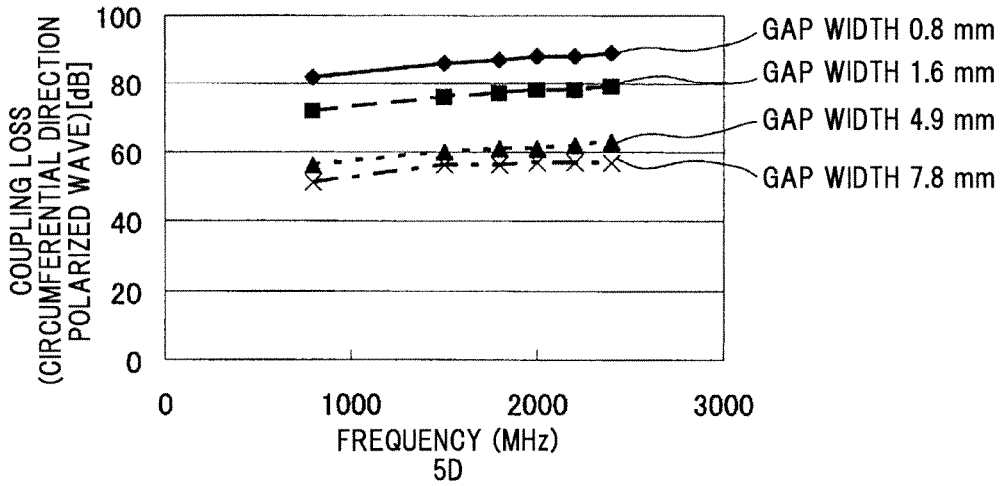
FIG. 14 is a graph showing a relationship between a coupling loss and a gap width Wg of a circumferential direction polarized wave within a range from 800 MHz to 2400 MHz in Examples 13 to 16 (5D)
Figure 15:
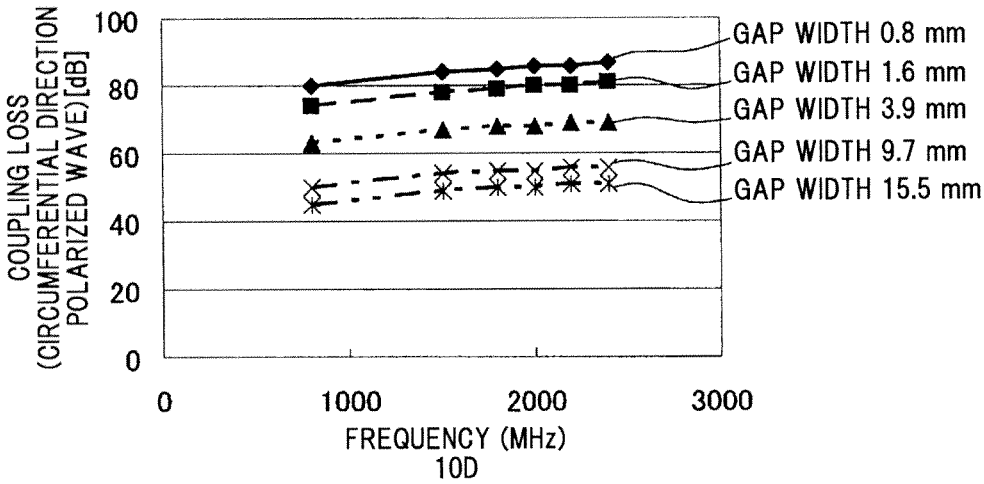
FIG. 15 is a graph showing a relationship between a coupling loss and a gap width Wg of a circumferential direction polarized wave within a range from 800 MHz to 2400 MHz in Examples 17 to 21 (10D)

FIGS. 14 and 15 show a relationship between the coupling loss and the gap width Wg of the circumferential direction polarized wave within a range from 800 MHz to 2400 MHz in Examples 13 to 16 (5D) and Examples 17 to 21 (10D), respectively.

Figure 16:
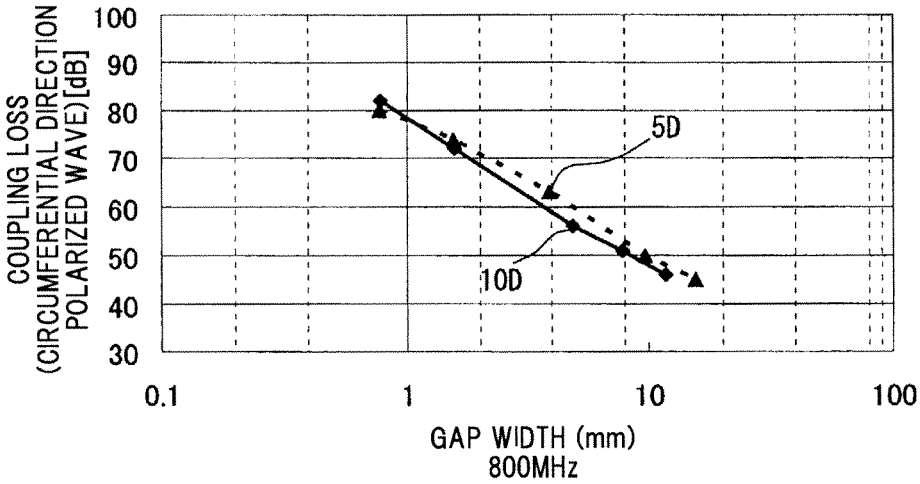
FIG. 16 is a graph showing a relationship between a coupling loss and a gap width Wg of a circumferential direction polarized wave at 800 MHz in Examples 13 to 16 (5D) and Examples 17 to 21 (10D)

FIG. 16 shows a relationship between the coupling loss and the gap width Wg of the circumferential direction polarized wave at 800 MHz in Examples 13 to 16 (5D) and Examples 17 to 21 (10D).

The coupling loss of the circumferential direction polarized wave is preferably 90 dB or less. It would be clearly understood from FIGS. 14 to 16 that the gap width Wg is preferably 0.5 mm or more, and more preferably 0.8 mm or more, for achieving the desired coupling loss.

The coupling loss of the circumferential direction polarized wave is more preferably 55 dB or more and 80 dB or less. For achieving the coupling loss in this desired range, the gap width Wg is preferably 0.9 mm or more and 6 mm or less.

Second Embodiment

Next, the second embodiment will be explained below. In the second embodiment, elements (configuration) identical to or similar to those in the first embodiment are assigned with similar names or reference numerals, respectively, and the detailed explanation thereof is omitted.

Figure 17:
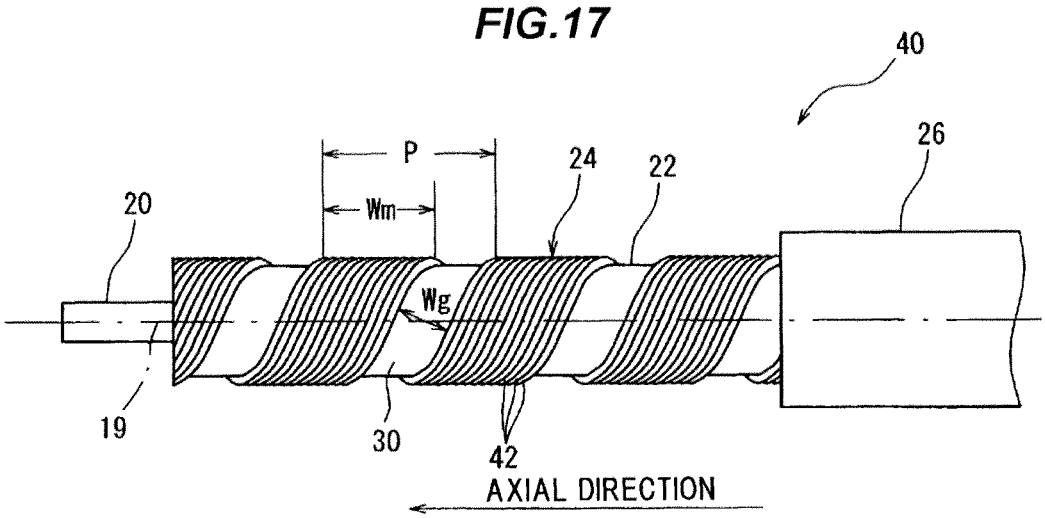
FIG. 17 is a schematic diagram showing a side view of an electromagnetic wave radiation coaxial cable in a second embodiment according to the invention.
Figure 18:
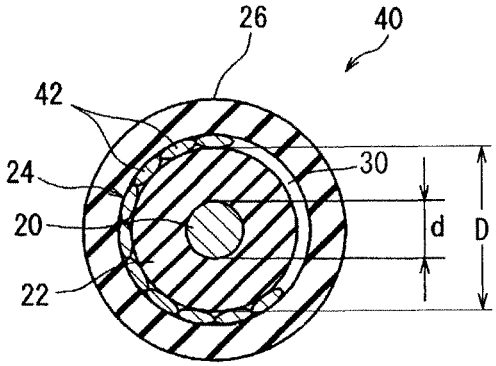
FIG. 18 is a schematic diagram showing a transverse cross sectional view of the electromagnetic wave radiation coaxial cable in FIG. 17.

FIG. 17 is a schematic diagram showing a side view of an electromagnetic wave radiation coaxial cable 40 in the second embodiment according to the invention. FIG. 18 is a schematic diagram showing a transverse cross sectional view of the electromagnetic wave radiation coaxial cable 40 in the second embodiment according to the invention.

Referring to FIGS. 17 and 18, the electromagnetic wave radiation coaxial cable 40 includes an outer conductor 24 formed of a plurality of conductor wires 42, in place of the metal foil 28 in the first embodiment.

The conductor wires 42 are arranged in parallel to each other to have a band shape and are spirally wound around the surface of the insulator 22 at a predetermined pitch P. The conductor wires 42 also form a gap 30. The conductor wires 42 of the outer conductor 24 are as a whole wound in a single helix (i.e. spirally wound in a single winding) around the insulator 22. In other words, the electromagnetic wave radiation coaxial cable 40 has such a configuration that the metal foil 28 of the electromagnetic wave radiation coaxial cable 10 is divided into plural strips.

Similarly to the electromagnetic wave radiation coaxial cable 10 of the first embodiment, the electromagnetic wave radiation coaxial cable 40 of the second embodiment radiates the circular polarized electromagnetic wave stably when the radio frequency signal is input to the inner conductor 20.

The electromagnetic wave radiation coaxial cable 40 is resistant to the bending, since the electromagnetic wave radiation coaxial cable 40 includes the plural conductor wires 42.

The present invention is not limited to the first and second embodiments described above. The present invention also includes modifications to the first and second embodiments.

For example, the transmission system 12 of the first embodiment described above comprises a single electromagnetic wave radiation coaxial cable 10. However, the present invention is not limited thereto. The transmission system 12 may comprise a plurality of electromagnetic wave radiation coaxial cables 10.

Further, the installation position of the electromagnetic wave radiation coaxial cable 10 is not limited, and may be located outdoors, indoors, or even underground depending on the application of use.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. An electromagnetic wave radiation coaxial cable, comprising:

an inner conductor comprising a conductor and extending along a cable axis;

an insulator covering the inner conductor; and an outer conductor spirally wound around the insulator in a single winding at a predetermined pitch to form a gap consisting essentially of a single spiral groove from which a part of the insulator is exposed, wherein a formula is established as:

$$\sqrt{\varepsilon_r} - 1 < \frac{\lambda}{P} < \sqrt{\varepsilon_r} + 1$$

wherein λ is a wavelength of a radio frequency signal to be transmitted or received, ∈r is a relative dielectric constant of the insulator at the wavelength λ, and P is a winding pitch of the outer conductor along a direction of the cable axis, and wherein the electromagnetic wave radiation coaxial cable is configured to radiate a circular polarized electromagnetic wave when the radio frequency signal is applied to the inner conductor.

2. The electromagnetic wave radiation coaxial cable according to claim 1, wherein an occupation ratio of the outer conductor at a surface of the insulator is 50% or more.

3. The electromagnetic wave radiation coaxial cable according to claim 1, wherein a width of the gap in a direction perpendicular to side edges of the outer conductor when the gap is projected on a plane including the cable axis is 0.5 mm or more.

4. The electromagnetic wave radiation coaxial cable according to claim 1, wherein the outer conductor comprises a metal foil or a plurality of conductor wires.

5. The electromagnetic wave radiation coaxial cable according to claim 1, a frequency of the radio frequency signal is within a range from 800 MHz to 2400 MHz.

6. The electromagnetic wave radiation coaxial cable according to claim 1, wherein the single spiral groove continuously extends from an edge of the insulator to another edge of the insulator along the cable axis.

7. The electromagnetic wave radiation coaxial cable according to claim 1, wherein the single spiral groove continuously extends along the cable axis on an entirety of the insulator.

8. The electromagnetic wave radiation coaxial cable according to claim 1, wherein the relative dielectric constant of the insulator is in a range from 1.0 to 3.0.

9. The electromagnetic wave radiation coaxial cable according to claim 1, wherein a ratio of a width of the outer conductor to the winding pitch of the outer conductor is at least 50%.

10. A communication system, comprising:

an electromagnetic wave radiation coaxial cable as an antenna, the electromagnetic wave radiation coaxial cable comprising an inner conductor comprising a conductor and extending along a cable axis, an insulator covering the inner conductor, and an outer conductor spirally wound around the insulator in a single winding at a predetermined pitch to form a gap consisting essentially of a single spiral groove from which a part of the insulator is exposed, wherein a formula is established as:

$$\sqrt{\varepsilon_r} - 1 < \frac{\lambda}{P} < \sqrt{\varepsilon_r} + 1$$

wherein λ is a wavelength of a radio frequency signal to be transmitted or received, ∈r is a relative dielectric constant of the insulator at the wavelength λ, and P is a winding pitch of the outer conductor along a direction of the cable axis, wherein the electromagnetic wave radiation coaxial cable is configured to radiate a circular polarized electromagnetic wave when the radio frequency signal is applied to the inner conductor.

11. The communication system according to claim 10, wherein an occupation ratio of the outer conductor at a surface of the insulator is 50% or more.

12. The communication system according to claim 10, wherein a width of the gap in a direction perpendicular to side edges of the outer conductor when the gap is projected on a plane including the cable axis is 0.5 mm or more.

13. The communication system according to claim 10, wherein the outer conductor comprises a metal foil or a plurality of conductor wires.

14. The communication system according to claim 10, a frequency of the radio frequency signal is within a range from 800 MHz to 2400 MHz.

15. The communication system according to claim 10, wherein the single spiral groove continuously extends from an edge of the insulator to another edge of the insulator along the cable axis.

16. The communication system according to claim 10, wherein the single spiral groove continuously extends along the cable axis on an entirety of the insulator.

17. The communication system according to claim 10, wherein the relative dielectric constant of the insulator is in a range from 1.0 to 3.0.

18. The communication system according to claim 10, wherein a ratio of a width of the outer conductor to the winding pitch of the outer conductor is at least 50%.

* * * * *